US005507118A

United States Patent [19]

Brown

[11] Patent Number: 5,507,118

[45] Date of Patent: Apr. 16, 1996

[54] WINDOW GUARD

[76] Inventor: Gerald L. Brown, 133 Tarpon Dr., Holden Beach, N.C. 28462

[21] Appl. No.: 397,425

[22] Filed: Mar. 1, 1995

[51] Int. Cl.[6] ..... E05B 65/04

[52] U.S. Cl. ..... 49/61; 49/57; 49/465; 248/173

[58] Field of Search ..... 49/61, 62, 57, 49/50, 465, 463; 52/202, 203; 248/173, 431; 292/338

[56] References Cited

U.S. PATENT DOCUMENTS

| | | | |
|---|---|---|---|
| 810,604 | 1/1906 | Baier . | |
| 966,195 | 8/1910 | Golden | 49/465 X |
| 1,731,114 | 10/1929 | Sparrow . | |
| 2,183,135 | 12/1939 | Dorf . | |
| 2,417,233 | 3/1947 | Buford . | |
| 2,549,661 | 4/1951 | Carney . | |
| 2,622,285 | 12/1952 | Roos . | |
| 2,777,174 | 1/1957 | Carr . | |
| 2,794,217 | 6/1957 | Croft . | |
| 3,952,983 | 4/1976 | Crochet | 248/173 |
| 4,266,594 | 5/1981 | Gunn . | |
| 4,400,911 | 8/1983 | Bell et al. | 49/57 X |
| 4,685,261 | 8/1987 | Seaquist . | |
| 4,726,149 | 2/1988 | Tryba . | |
| 5,007,200 | 4/1991 | Londono . | |
| 5,181,686 | 1/1993 | Barthel | 248/173 X |
| 5,269,096 | 12/1993 | Hade . | |
| 5,283,979 | 2/1994 | Carlson et al. | 49/465 X |

FOREIGN PATENT DOCUMENTS

| | | | |
|---|---|---|---|
| 3824761 | 1/1990 | Germany | 49/465 |

*Primary Examiner*—Philip C. Kannan
*Attorney, Agent, or Firm*—Polster, Lieder, Woodruff & Lucchesi

[57] ABSTRACT

A window guard is provided for a window which may be removably mounted in a window frame to protect the window from storms. The window includes a window frame having frame members, two of which have holes formed on inwardly facing surfaces. The window guard includes a board sized to fit within the window frame and a brace or mounting mechanism pivotally mounted on the board which cooperates with the window frame holes to mount the window guard in the frame. The mounting mechanism includes a cross-member pivotally secured to the board and rods telescopingly received in the cross-member. The cross-member is made of two elongate pieces which are pivotally connected and which have blind bores formed in their ends which telescopingly receive the rods. The rods can thus telescope to a position in which they extend from the cross-member into the holes formed in the window frame and be retracted to a position in which they do not extend beyond the edges of the board. A screw is provided for each rod to be screwed against the rod to secure the rod in a desired position in the cross-member. Guide brackets are positioned near the edges of the board to provide a guide through which the rods extend.

17 Claims, 3 Drawing Sheets

WINDOW GUARD

BACKGROUND OF THE INVENTION

This invention relates to window guards, and, in particular, to a window guard to protect a window during a storm, such as a hurricane.

Window guards or protectors are well known. They generally are made of a board which is removably mounted to a window to cover the window. In the most simple version, a piece of ply-wood is nailed to the outside of a window frame. This can be rather permanent or may mar the window frame when removed from the building. Window guards which are easier to remove have been developed. Such removable window guards often include brackets mounted on an outer surface of the window frame. The guard includes bars which slide through the brackets to secure the guard to the window. The brackets, as can be imagined, are quite visible and detract from the aesthetic appearance of the window when not covered.

Some window guards dispense with the brackets and screw the guard directly to the window frame. This creates a visible hole in the window frame which will also detract from the aesthetic appearance of the window. Further, the screw hole can be used only a few times before the grip of the screw on the wood become so loose that the protector will no longer stay mounted to the frame without making new screw holes.

SUMMARY OF THE INVENTION

One object of the invention is to provide a removable window guard which will protect a window during a storm.

Another object is to provide such a window guard which is mounted to the window in such a way that it does not detract from the aesthetic appearance of the window when the guard is not mounted to the window.

Another object is to provide such a window guard which is easily mounted to the window, either from the inside of the structure or outside.

Another object is to provide such a window guard which is easily removed, stored, and can be used many times.

Another object is to provide such a window guard which is at least slightly adjustable, to give the installer some leeway in creating holes in the window frame.

These and other objects will become apparent to those skilled in the art upon review of the following disclosure in light of the accompanying drawings.

In accordance with the invention, generally stated, a window guard is provided which may be easily mounted to and removed from a window to protect the window during a storm. The window, as is common, includes a window frame having side members, a top member and a bottom member, and a window pane secured in the window frame. The window frame is provided with bores formed in at least two of the frame members. The window guard includes a board sized to fit in the window frame and a brace or mounting mechanism pivotally mounted to the board to removably mount the guard in the window frame.

The mounting mechanism includes a cross-member pivotally secured to the board. The cross-member is made of two first elongate pieces which are pivotally connected together. Each elongate piece has opposing ends in which axially extending bores are formed. Elongate rods are telescopingly received in the cross-member bores and are movable between an extended position in which the rods extend into the window frame holes and a compressed position in which the rods do not extend beyond the edge of the board. The rods are sufficiently long to extend beyond an edge of the board and into the frame bores but still have one end received within the cross-member bores when in the extended position. The bores are sufficiently deep so that the rods do not extend beyond the edge of the board when they are in the compressed position. A lock, preferably a set screw, is provided for securing the rods in a desired position to prevent axial movement of the rods relative to the cross-member.

To allow the cross-members to pivot relative to each other, an elongate slot is formed in an inner surface of each elongate piece of the cross-member. The slots have a length greater than the width of the cross-member pieces and depth equal to at least one-half the depth of the cross-member pieces. Preferably, the slots extend diagonally across the first and second pieces. The slots of the first and second elongate pieces mate with each other. A bolt hole extends through the slots through which a bolt extends to pivotally connect the first and second pieces together and to pivotally mount the mounting mechanism to the board.

A guide bracket for each rod is mounted to the board near the edges thereof. The guide bracket is L-shaped and includes an elongate slot through which the rods extend. The bracket slots are thus preferably aligned with the holes formed in the window frame. The holes are preferably formed near the corners of the window frame, thus the brackets are positioned inwardly of the corners of the board, and preferably near the edges of the board. The slot in the bracket defines a path of travel which limits the degree to which the cross-member and rods may be rotated on the board.

DESCRIPTION OF THE PREFERRED EMBODIMENT

Figure 4:
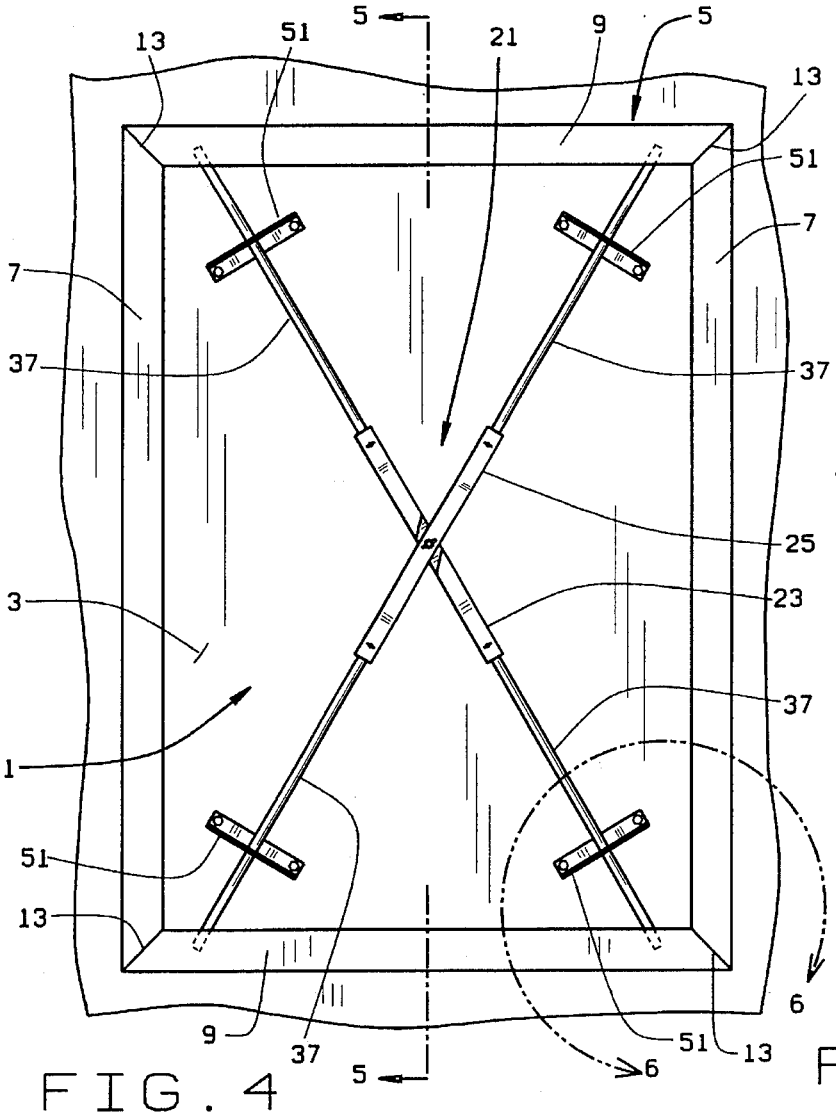
FIG. 4 is a plan view of the widow guard mounted in a window.

A window guard 1 of the present invention includes a board 3 sized and shaped to fit within the frame 5 (FIGS. 4–6) of a window assembly W (FIG. 5) to fully cover the glass G (FIG. 5) of the window. Board 3 may be made of any durable material which can withstand high winds, such as wood or Plexiglas, for example. If the board is made of Plexiglas, it can be either clear, translucent, or opaque. As is typical, the window frame 5 includes the side members 7 and the top and bottom members 9 which surround and frame the glass G. As will be described below, four holes 11 (one of which is best shown in phantom in FIG. 6) are drilled in the frame members to enable the window guard 1 to be removably mounted in the window frame. Holes 11 are drilled in inwardly facing surfaces of the frame members so that they are not readily visible when viewed straight on.

Preferably, holes 11 are drilled in the top and bottom frame members 9 near the corners 13 of the frame defined by the juncture of the side members 7 with the top and bottom members 9.

Figure 1:
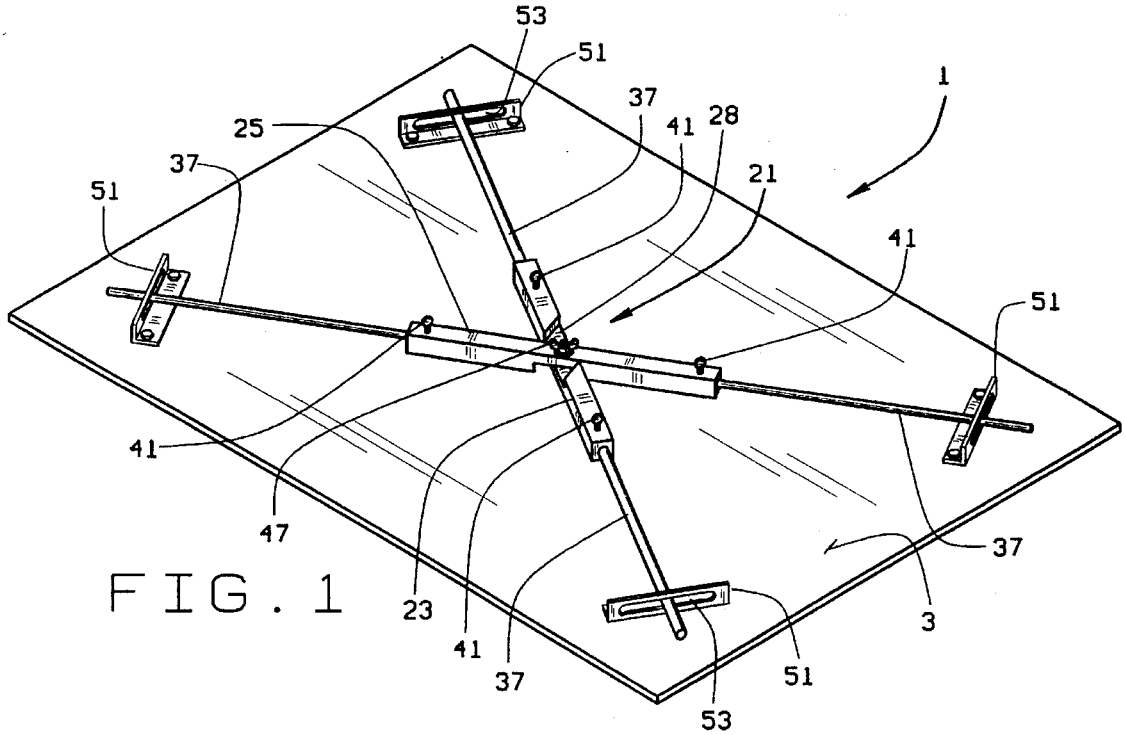
FIG. 1 is a perspective view of a window guard of the present invention.
Figure 2:
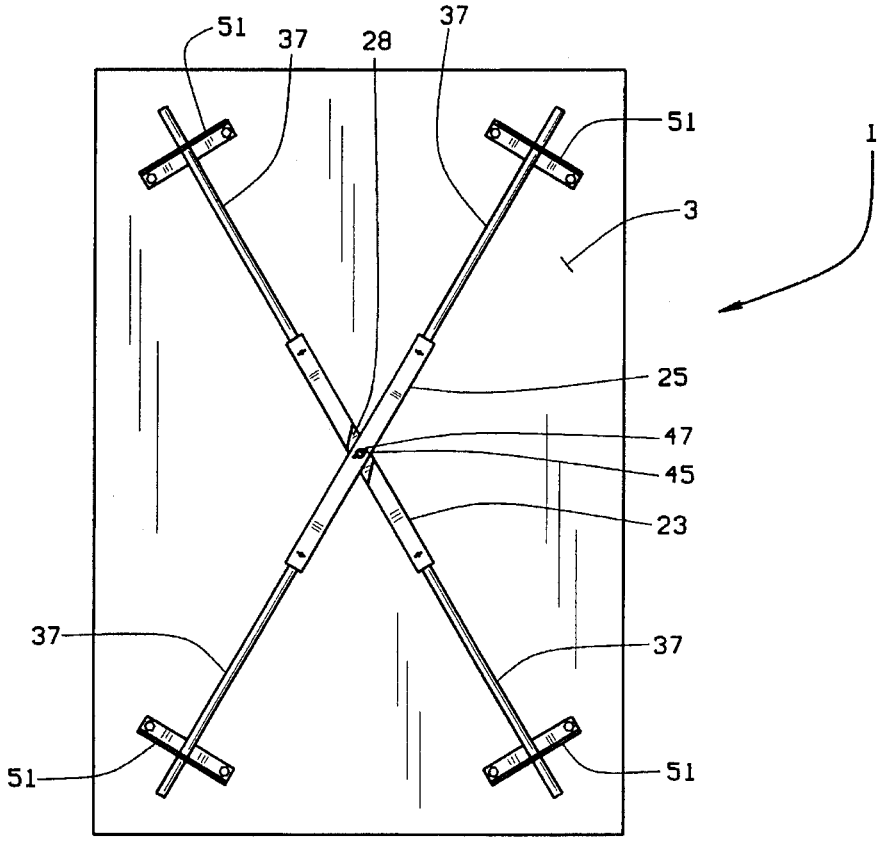
FIG. 2 is a plan view of the window guard.
Figure 3:
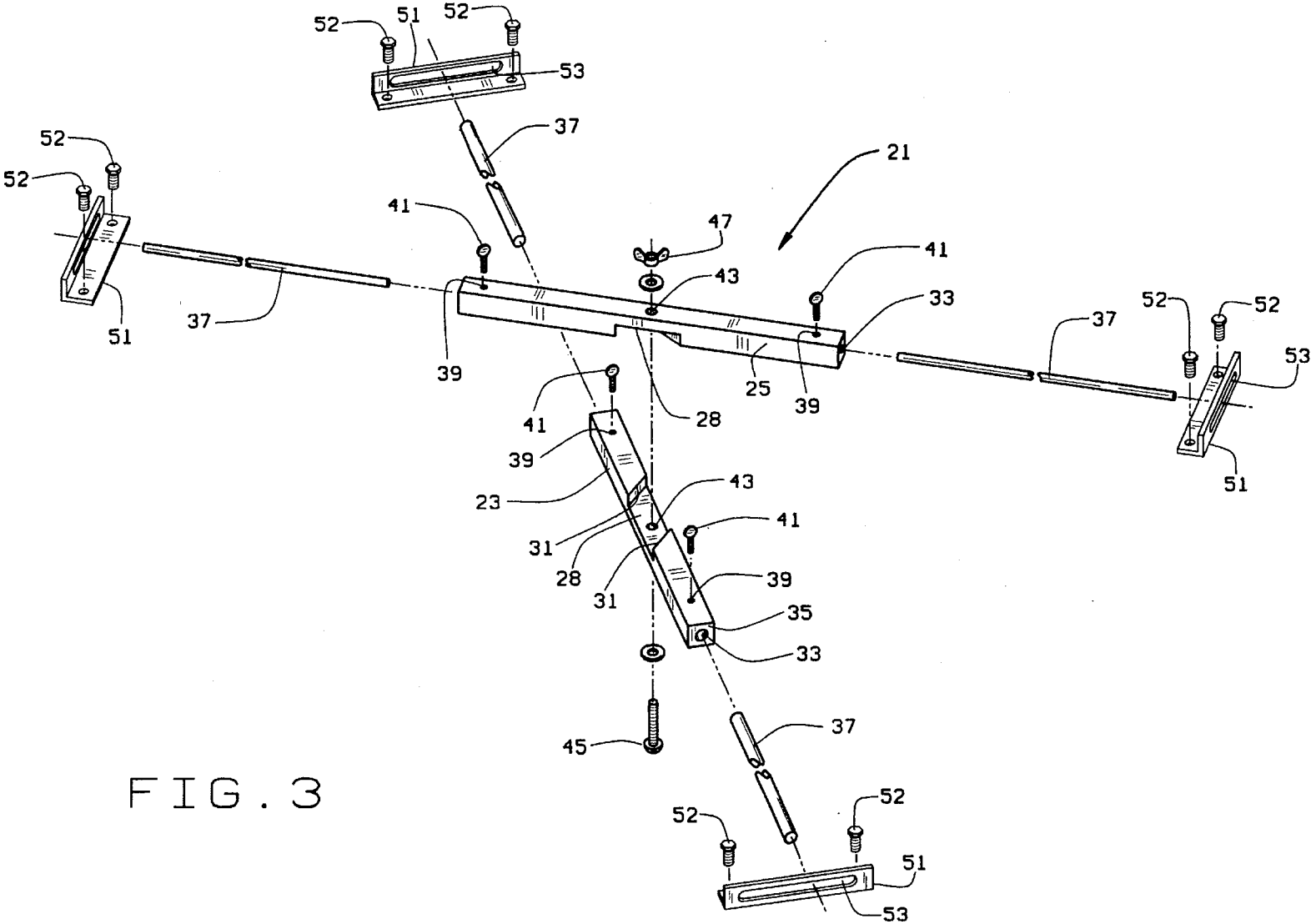
FIG. 3 is an exploded perspective view of the mounting mechanism of the window guard.

Turning to FIGS. 1–3, window guard 1 includes a mounting assembly 21 which cooperates with the holes 11 to removably mount the guard to the window. The mounting assembly 21 includes two identical cross-members 23 and 25 which are connected to each other and mounted to the board 3 such that they may pivot with respect to each other and with respect to the board 3. Each cross member is made of rectangular bar stock and has a channel 28 (FIG. 3) formed at its center. The channel 28 has side walls 31 which extend diagonally across the bar and are about ½ the height of the bars and have a length slightly greater than the width of the bar stock. Blind bores 33 are formed on the end surfaces 35 of the bars to receive rods 37. The rods 37 can slide in the bores 33. The blind bore 33 and the rods 37 are of a depth and length such that when the rods 37 are fully received in the bore 33, they do not extend beyond the edge of the board 3. However, when the rods 37 are telescoped to a mounting position they extend beyond the board 3 and still have a portion of the rod received in the bore 33. To fix the bars 37 in place in the bores 33, the members 23 and 25 include screw holes 39 on the top of the bar which receive the set screws 41. Preferably, the screws 41 have a winged end so that they may be loosened or tightened without the use of a screwdriver. By screwing the screw 41 into the screw hole 39, and against the rod 37, the rod will be secured in a desired position.

Figure 5:
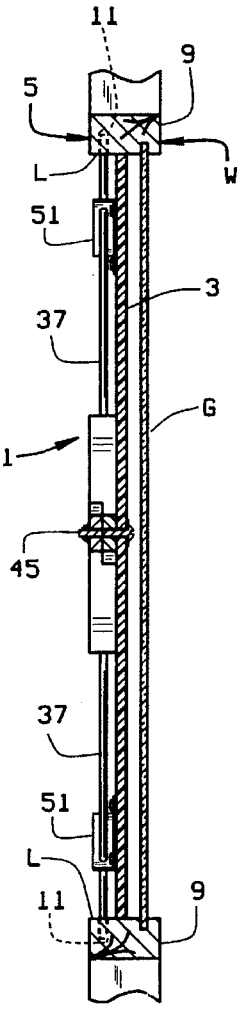
FIG. 5 is a cross-sectional view taken along line 5—5 of FIG. 4.
Figure 6:
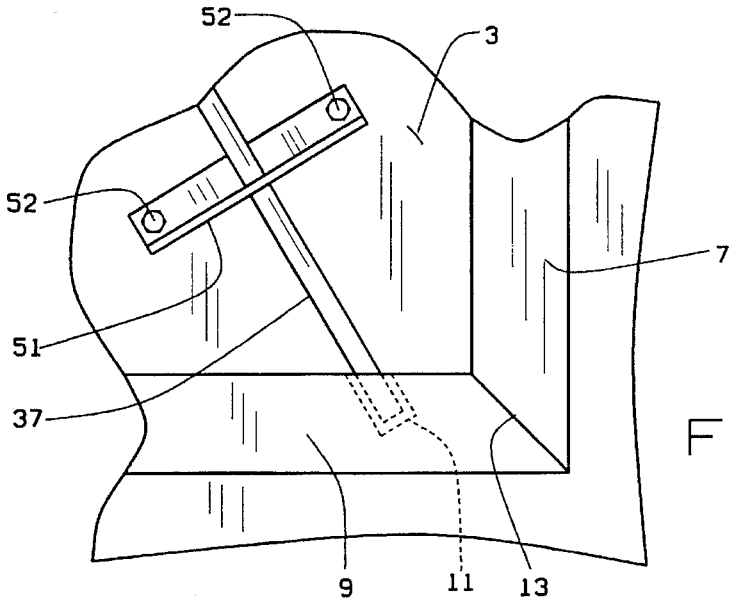
FIG. 6 is an enlarged view taken along line 6—6 of FIG. 4.

The two members mate together by laying the channel 28 of member 25 over the channel 28 of member 33, as best shown in FIG. 1. Each member has a bolt hole 43 formed centrally of the channel 28 through which a fastener 45, such as bolt, extends to connect the two members together. The orientation and size of the channels 28 allow for the two members to be pivoted slightly with respect to each other when they are bolted together. As best seen in FIG. 5, the bolt 45 extends through the board 3, preferably at the center of the board, to secure the members 23 and 25, and hence the mounting assembly 21, to the board. A wing nut 47 is threaded on to the end of the bolt to secure the mounting assembly 21 to the board. Because the bolt 45 is the only direct connection between the assembly 21 and the board 3, the assembly 21 may pivot with respect to the board.

Four brackets 51 are mounted to the board 3 diagonally inwardly from the corners of the board by screws 52. The brackets 51 are preferably L-shaped brackets having a solid leg which is in contact with the board 3 and through which the screws 52 extend to mount the bracket to the board. A second leg extends perpendicularly from the first leg and the board and has an elongate slot 53. The brackets 51 are positioned on the board 3 such that the rods 37 can extend through the slots 53 and into the holes 11. The brackets 51 thus serve as guides when extending the rods 37 into the holes 11. An imaginary line extending from the window frame holes 11 to the bolt 45 which holds the mounting mechanism 21 to the board 3 thus extends through the bracket slots 53, and preferably through the middle of the slots 53. The slots 53 limit the extent to which the assembly 21 may be pivoted on the board 3. Thus, the imaginary line does not have to extend through the middle of the bracket slot, providing some leeway in the drilling of the holes 11. The brackets 51 are mounted such that the assembly 21 forms an "X" across the board 3. Although the "X" configuration is preferred, the assembly could be mounted so that the bars 37 extend vertically and horizontally across the board 3 (i.e., forming a "+").

To mount the window guard 1 in a window frame 5, the guard 1 is placed within the frame with the bars 37 in their contracted position. The angular positions of the assembly 21 and of the cross-members 23 and 25 are adjusted, if necessary to align the rods 37 with the holes 11 formed in the widow frame. The rods are then extended to be received within the holes and are secured in place by tightening the screws 41 down on the bars 37.

As is apparent, the window guard 1 is utilized best in widows in which the frame is not flush with the window glass G, but rather forms a ledge L with the glass. The guard 1 can be positioned to be either on the outside of the window or on the inside, depending on where the ledge is located. Obviously, the glass G will only be protected from a storm if the guard 1 is located on the outside of the building in which the window is located. However, by mounting the guard inside the window, the guard will allow for closing up a building, such as a vacation home, when not in use. This will prevent people from entering the home through the window to protect the belongings inside the house. Because the mounting mechanism 21 will be inaccessible from outside the window, the guard 1 could not be removed if it were mounted inside the building.

Because the holes 11 are formed in inwardly facing surfaces of the frame, they extend along a plane parallel to the wall, and thus are not readily visible. The guard 1 thus does not impair the aesthetic appearance of the window frame. The guard 1, as can be seen, is easy to use and can be quickly put up to protect a window from a storm or to close up a house when not in use. The guard 1 can be just as easily taken down.

Variations within the scope of the appended claims may be apparent to those skilled in the art. For example, springs could be placed in the blind bores 33 to normally bias the rods 37 into the holes 11. The set screws 41 would not be needed to hold the bars in the extended position, but only to maintain the bars in the retracted position for mounting the guard on and removing the guard from the window. The cross-member bores 33 could be internally threaded and the rods 37 could have threaded ends, so that the rods could be threaded into the bores. This would allow for the elimination of the screws 41, and the rods would be extended and retracted by rotation of the rods. The holes 11 in the window frame 5 could be formed in the side members 7, rather than in the top and bottom members 9. The placement of the holes 11 are dependent upon the angle formed by the bars 23 and 25 of mounting mechanism 21. All that is preferred is that the holes 11 be formed near the corners 13 of the window frame 5. These examples are merely illustrative.

I claim:

1. In combination, a window and a window guard, the window including a window frame having side members, a top member and a bottom member, and a window pane secured in said window frame, said window frame having holes formed in at least two of said frame members; said window guard including a board sized to fit in said window frame and a mounting mechanism mounted to said board to removably mount said guard in said window frame; said mounting mechanism including:

a cross-member secured to said board, said cross-member including a first elongate piece and a second elongate piece pivotally secured to said first elongate piece; each elongate piece having opposing ends and defining axial bores extending inwardly from said ends;

rods telescopingly received in said cross-member bores, and movable between an extended position and compressed position, said rods being sufficiently long to extend beyond an edge of said board and into said window frame holes when in said extended position and said axial bore being sufficiently deep such that said rods are within said board edges when in said compressed position; and a lock for securing said rods in a desired position to prevent axial movement of said rods relative to said cross-member.

2. The combination of claim 1 wherein said cross-member first and second pieces each have an inner surface defining an elongate slot, said slot having a length greater than the width of said cross-member pieces and depth equal to at least one-half the depth of said cross-member pieces; said slots of said first and second elongate pieces mating with each other, each said cross-member pieces further including a hole which extends through said slot, said hole receiving a fastener to pivotally connect said first and second pieces together and to pivotally mount said mounting mechanism to said board.

3. The combination of claim 2 wherein said lock includes a screw received in a screw hole formed in said first and second pieces, said screw bearing against said rod when said rod is in a desired position.

4. The combination of claim 3 including a bracket for each rod, said brackets being positioned near edges of said board.

5. The combination of claim 4 wherein said brackets each have an elongate slot through which said rod extends, said elongate slot defining a path over which said cross-member pieces may pivot.

6. The combination of claim 4 wherein said window frame holes are positioned near corners of said window frame; said cross-member and said rods extending diagonally across said board to form an "X".

7. The combination of claim 6 wherein said window frame holes are formed in said top and bottom members, each bottom and top member having two holes formed therein, one hole being formed near one end of said member and a second hole being formed near the other end of said member.

8. The combination of claim 7 wherein said holes in said window frame members are formed in inwardly facing surfaces of said widow frame members.

9. A window guard mountable in a window frame, said window guard including a board sized to fit in said window frame and a mounting mechanism pivotally mounted to said board to secure said guard in said window frame; said mounting mechanism including:

a cross-member secured to said board, said cross-member including a first elongate piece and a second elongate piece pivotally secured to said first elongate piece, each elongate piece having opposing ends and defining axial bores extending inwardly from said ends;

rods telescopingly received in said cross-member bores, and movable between an extended position and compressed position, said rods being sufficiently long to extend beyond an edge of said board when in said extended position and to be within said board edges when in said compressed position; and a lock for securing said rods to prevent axial movement of said rods relative to said cross-member.

10. The window guard of claim 9 wherein said cross-member first and second elongate pieces each have an inner surface defining an elongate slot, said slot having a length greater than the width of said cross-member pieces and depth equal to at least one-half the depth of said cross-member pieces; said slots of said first and second elongate pieces mating with each other, said cross-member pieces further including through holes which extend through said slot, said holes receiving a fastener to pivotally connect said first and second pieces together.

11. The window guard of claim 10 wherein said lock includes a screw received in a screw hole formed in said first and second pieces, said screw bearing against said rod when said rod is in a desired position.

12. The window guard of claim 11 including a bracket for each rod, said brackets being positioned near edges of said board.

13. The window guard of claim 12 wherein said brackets each have an elongate slot through which said rod extends, said elongate slot defining a path over which said cross-member pieces may pivot.

14. The window guard of claim 12 wherein said rods are crossed and extend diagonally across said board.

15. A brace for a window guard, the brace comprising:

a cross-member having a first elongate piece and a second elongate piece; said first and second elongate pieces being pivotally connected; each elongate piece having opposing ends defining axial bores extending inwardly from said ends; said cross-member first and second pieces each having an inner surface defining an elongate slot, said slot having a length greater than the width of said cross-member pieces and depth equal to at least one-half the depth of said cross-member pieces; said slots of said first and second piece mating with each other, each said cross-member piece further including a hole which extends through said slot, said holes receiving a fastener to pivotally connect said first and second pieces together;

elongate rods telescopingly received in said cross-member bores, and movable between an extended position and compressed position; and a lock for securing said rods to prevent axial movement of said rods relative to said cross-member.

16. The brace of claim 15 wherein said lock includes a screw received in a screw hole formed in said first and second pieces, said set screw bearing against said rod when said rod is in a desired position.

17. The brace of claim 15 wherein said slots extend diagonally across said first and second pieces.

* * * * *